US005868654A

United States Patent [19]

Norian

[11] Patent Number: 5,868,654

[45] Date of Patent: Feb. 9, 1999

[54] UPPER BODY EXERCISER

[76] Inventor: Alan Andin Norian, 418 W. Main St., Ground, Wash. 98604

[21] Appl. No.: 915,353

[22] Filed: Aug. 20, 1997

[51] Int. Cl.[6] ..... A63B 23/02; A63B 21/04; A63B 21/045

[52] U.S. Cl. ..... 482/140; 482/95; 482/96; 482/127; 482/130

[58] Field of Search ..... 482/95, 96, 121, 482/127, 129, 130, 133, 137, 138, 140

[56] References Cited

U.S. PATENT DOCUMENTS 4,949,258 8/1990 Richey ..... 482/96
5,002,271 3/1991 Gonzales ..... 482/130
5,110,121 5/1992 Foster ..... 442/130 X
5,692,997 12/1997 Stearns ..... 482/137 X

*Primary Examiner*—John Mulcahy

[57] ABSTRACT

The upper body exerciser assists the user in the performance of sit-up exercises. An inclining and reclining backrest is pivotally attached to a frame. An independent backrest support is pivotally attached to the frame behind the backrest. A pair of handles are operatively connected to the backrest support by a cable and pulley system. A pair of torsion springs are connected to the backrest support so as to operatively engage the backrest. The user pulls down on the handles to move the backrest support to lift the backrest through a first portion of a sit-up exercise. The torsion springs then propel the backrest forward to assist the user in completing the exercise.

20 Claims, 2 Drawing Sheets

UPPER BODY EXERCISER

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

Invention relates to Physical fitness equipment, Exercise machines, Physical therapy/rehabilitation machines.

BRIEF SUMMARY OF THE INVENTION

The Upper Body Exerciser is a fitness machine which enables persons to condition the upper body and to perform full slant situps at a diagonal angle. The ergonomically correct positioning of the traveling backrest allows persons exercising to flex at the waist. Persons performing isometric situps also have the benefit of said backrest being a double-motion design which supports the back all the way during inclines and reclines and thus facilitates the safe and balanced repetitions of complete, extended situps.

DETAILED DESCRIPTION OF THE INVENTION

Figure 1:
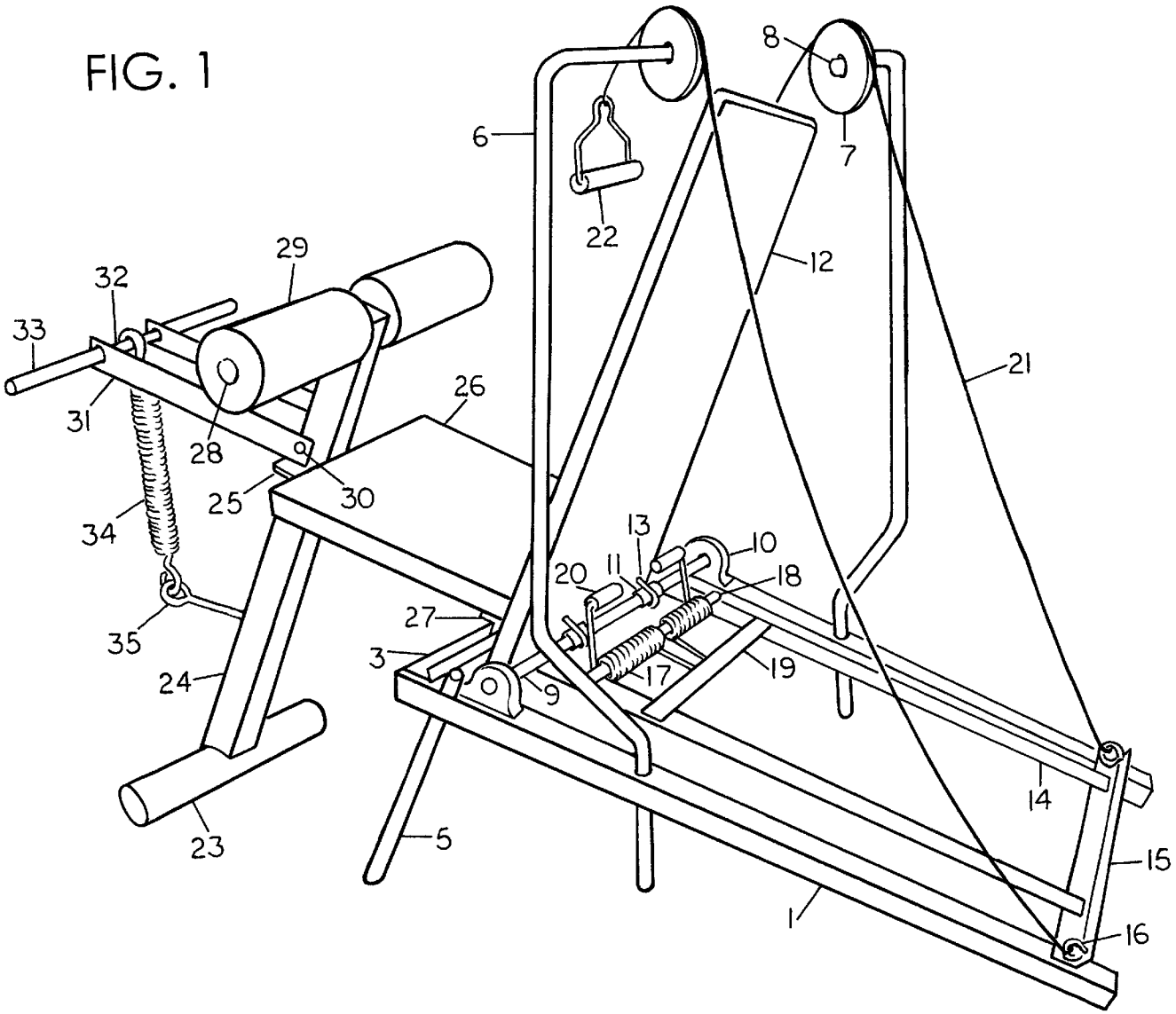
FIG. 1—Main perspective illustration

Main Frame Assembly—Two 1½" square, 4.3" long tubes (1) paralleled 16¼" apart. Ends of 1½" wide flatbar (2) welded at ends of tubes resting on floor [FIG. 2]. Ends of 1¼" angle iron (3) welded atop the raised ends of square tubes. Two rubber drums (4) are vertically secured to the inside of angle iron (FIG. 2) 6" apart, said drums being only ⅛" away from upright side of angle iron. Ends of two 1" diameter, 13" long tube legs (5) are inserted through 1" diameter holes drilled in square tubes directly behind angle iron. Bottom ends of legs (5) are cut at an angle so that when front end of rectangular frame is raised, the bottoms of said legs will rest flat on the floor.

Pulley Pole Assembly—Two ¾" diameter tubes, 50" high (6) bent 5" outward allow upper body to come through (bends shown on FIG. 1). Two 4" diameter sheaves (7) are attached to tops of poles by means of axle bolts (8) inserted through hubs of sheaves and into ends of pole tubes (FIG. 1). Sheaves (7) rotate upon said axle bolts (8). The pulley poles (6) are vertically inserted into ¾" holes drilled through the square tubes (1) of the main frame 15" from the raised ends.

DOUBLE MOTION BACKREST ASSEMBLY—Ends of ¾" diameter, 19" long stainless steel linear shaft (9) inserted into base mount pillow blocks (10). Pillow block bearings (10) are mounted onto the square tubes (1) of mainframe directly behind the legs in front. Two sleeve bearings (11) [FIG. 1] slip onto and rotate around the linear shaft (9). The short end of 12" by 35" rectangular backrest (12) is attached to sleeve bearings (11) with U-bolts (13) [FIG. 1], enabling the backrest to rotate around and upon the linear shaft (9). The ends of two 1½" wide, 35" long flat swaybars (14) are welded perpendicularly to the linear shaft (9). The sleeve bearings (11) to which the pivoting backrest (12) is bolted are between the two parallel swaybars (14). The other ends of the two swaybars (14) are welded into the inside corner of 19" long angle iron (15). The inside ends of said angle iron (15) contain two eye bolts (16). Mounted upon the parallel swaybars, directly behind the linear shaft, are two heavy torsion springs with 90 degree deflection (17). Said springs are slipped over a supporting arbor tube (18) [FIG. 1] the ends of which are perpendicularly attached to the parallel swaybars (14) meaning that the springs are located between the said bars, directly behind and parallel to the linear shaft (9). An anchor strip (19) directly behind and parallel to the spring coils (17) welded perpendicularly to and between the swaybars (14). The two lower legs of springs (17) are attached to anchor strip (19) while the top two unsecured legs of torsion springs have a 90 degree bend with revolving rollers (20) so that friction between the springs and backrest will be minimized.

Cable Assembly—Two steel cables (21) 58" long with stirrup handles (22) at one end and the other ends connected to the eye bolts (16) attached to angle iron (15). Cables (21) run over the supporting sheaves (7) with the handles (22) hanging in front of the sheaves atop the vertical poles (6).

Figure 2:
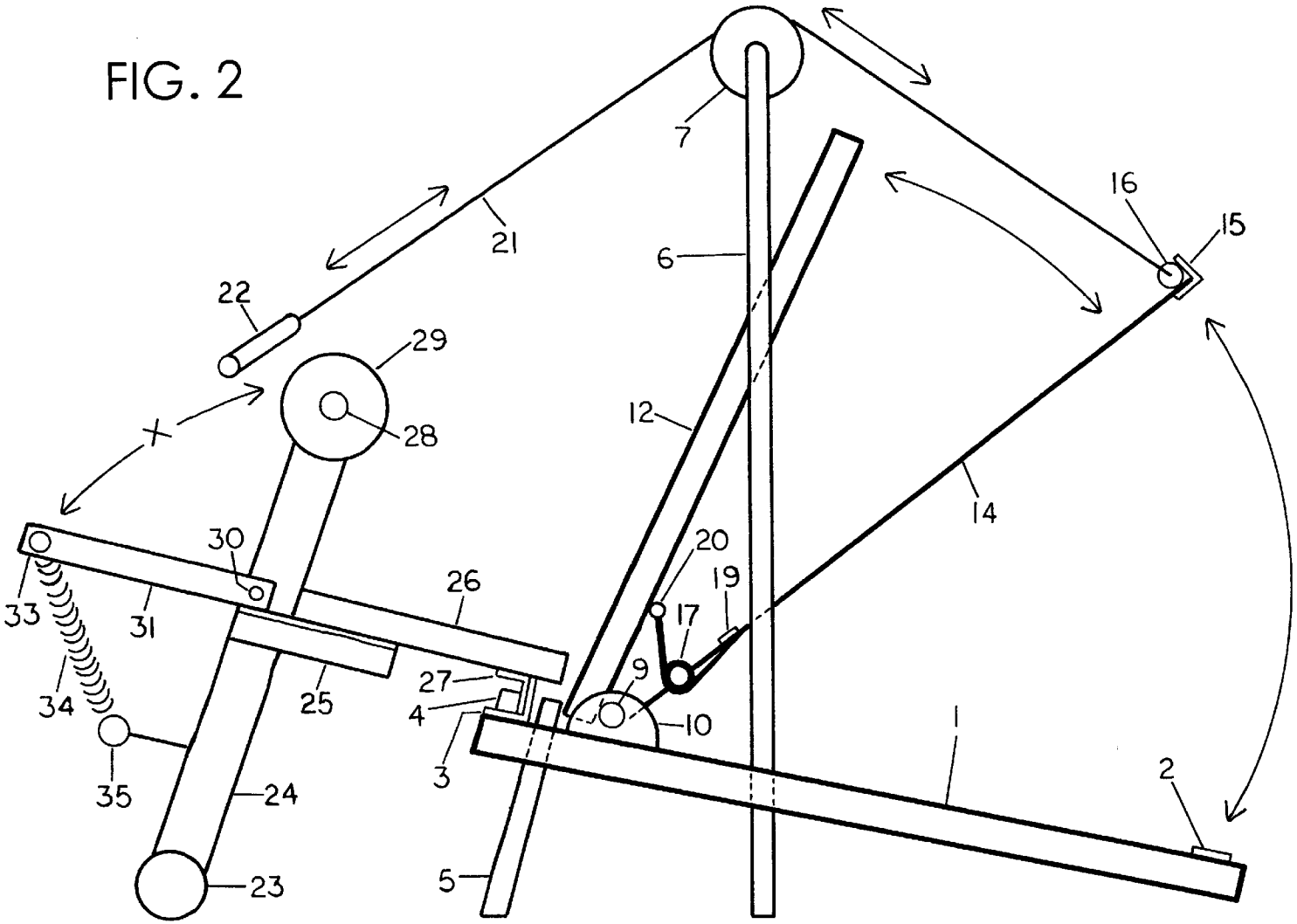
FIG. 2—Straight profile view for the main purpose of depicting the function and design of the double motion backrest

PRINCIPLE AND FUNCTION OF "DOUBLE MOTION" BACKREST—FIG. 2 Person exercises by laying on backrest, reclines all the way back, forcing the springs under back support to compress. Arms reach up and take hold of handles. Person presses or pulls down then forward on handles, causing the swaybar assembly under back-rest to lift him/her up. As the person is sitting up, the springs within the swaybar framework kick in, expanding and helping one to complete situp and exercise. Consequently the lower back is supported by the independently moving backrest pressing against it and thus facilitating complete incline situps. The process is reversed upon the recline.

Seat and Arm Exerciser Assembly—15" long, 2" diameter round or square horizontal floor tube (23). 2" square, 27¼" long seat support tube (24) bottom cut at an angle and welded to middle of floor tube resulting in diagonal tilt to the rear. Two 1" angle irons, 7" in length (25) are welded perpendicularly to each side of seat support tube (24) 16" from top of floor tube (23). This means that 12" by 15" seat (26) attached to prop angles (25) will be sloping downward. 1¼" angle iron, 12" long (27) is fastened near bottom edge of seat. Pointed down side of said angle iron (27) is set between pointed up side of mainframe angle iron (3) and rubber drums (4), i.e. resting against inside corner of angle iron on raised end of mainframe. Seat (26) and fully reclined backrest (12) will thus be lined up straight and even at a diagonal angle. An 18" long, 1" diameter rod or tube (28) is inserted through 1" diameter hole drilled in the sides of tube (24) at the top. Two foam rollers (29) are slipped over rod (28). These rollers act as either knee OR underarm supports. ⅜" diameter hole is drilled through the sides of tube (24) ¾" above the seat props (25) and 3½" long pin (30) is inserted through said hole with both ends protruding from sides of tube (24). Two 15" long, 1½" wide strips or braces (31) have ½" holes drilled in one end and ⅜" holes in the other ends. The ends of braces (31) with ⅜" holes are secured to the protruding ends of pin (30) on each side of square tube (24). The other ends of parallel braces (31) have 18" long rod [FIG. 1] secured through the ½" holes. 6" long tubular handles (33) are slipped over each end of rod (32). One end of 9" long extension spring (34) is fitted over rod (32) between the parallel braces (31). The other end of spring is connected to eye bolt (35) near the bottom front of square tube (24). The pin (30) that the ends of braces (31) are attached to pivots inside the holes drilled through sides of square tube (24). Braces (31) on each side of said tube rest on seat prop angles (25) below.

Dual Function of Seat Assembly—Person performing situp exercises rests the back of the knees on the foam rollers (29) while the raised feet are secured under the handles (33). Person doing curls rests the chest and upper arms on the rollers (29) with feet on the floor while the hands, holding the handles (33) lift and lower the parallel strips (31) which extend and contract the spring (34). Arrow x indicates said motion in FIG. 2.

I claim:

1. A sit-up exercise machine, comprising:

a frame;

an inclining and reclining backrest, the backrest being pivotally attached to the frame proximate one end thereof for movement about a first axis; and means for assisting a person through a portion of a sit-up exercise, comprising:

a backrest support for supporting the backrest through a first portion of a sit-up exercise motion from a reclined position to a partially inclined position, the backrest support being movably mounted to the frame independently of the backrest;

a cable and pulley system including a handle, the cable operatively connecting the handle and the backrest support for moving the backrest support to incline the backrest when a user manipulates the handle; and a spring mechanism operatively connected between the backrest support and backrest for propelling the backrest from the partially inclined position toward an inclined position.

2. The sit-up exercise machine of claim 1, wherein the cable and pulley system includes a pulley mounted to the frame above the backrest.

3. The sit-up exercise machine of claim 1, wherein the cable and pulley system comprises a pair of cables, a pair of handles and a pair of pulleys, the pulleys being mounted on pulley supports on either side of the backrest, the cables each having a first end attached to a respective handle, an intermediate portion engaging a respective pulley and a second end attached to the backrest support.

4. The sit-up exercise machine of claim 3, wherein the backrest support is pivotally attached to the frame.

5. The sit-up exercise machine of claim 4, wherein the backrest support is pivotally attached to the frame for movement about the first axis.

6. The sit-up exercise machine of claim 5, wherein the spring mechanism comprises a torsion spring.

7. The sit-up exercise machine of claim 6, wherein the torsion spring is attached to the backrest support.

8. The sit-up exercise machine of claim 7, wherein revolving rollers are mounted on an end of the torsion spring for contact with the backrest.

9. The sit-up exercise machine of claim 1, further comprising a seat mounted to the frame proximate the first axis and in front of the backrest.

10. The sit-up exercise machine of claim 9, further comprising a limb support mounted to the frame in front of the seat.

11. The sit-up exercise machine of claim 10, wherein the limb support comprises a roller pad.

12. The sit-up exercise machine of claim 9, further comprising a lever having a first end pivotally mounted to the frame in front of the seat for movement about a second axis, a second end equipped with a handle, and a spring for resisting movement of the lever about the second axis.

13. The sit-up exercise machine of claim 9, wherein the backrest support is pivotally attached to the frame.

14. The sit-up exercise machine of claim 9, wherein the backrest support is pivotally attached to the frame for movement about the first axis.

15. The sit-up exercise machine of claim 9, wherein the spring comprises a torsion spring.

16. The sit-up exercise machine of claim 15, wherein the torsion spring is attached to the backrest support.

17. The sit-up exercise machine of claim 15, wherein revolving rollers are mounted on an end of the torsion spring for contact with the backrest.

18. The sit-up exercise machine of claim 15, wherein the torsion spring includes a wound section and two ends, the wound section surrounding a spring support connected to the backrest support, one of the ends being anchored on the backrest support and the other end contacting the backrest.

19. The sit-up exercise machine of claim 9, the cable and pulley system comprises a pair of cables, a pair of handles and a pair of pulleys, the pulleys being mounted on pulley supports on either side of the backrest, the cables each having a first end attached to a respective handle, an intermediate portion engaging a respective pulley and a second end attached to the backrest support.

20. The sit-up exercise machine of claim 1, wherein spring mechanism comprises a torsion spring including a wound section and two ends, the wound section surrounding a spring support connected to the backrest support, one of the ends being anchored on the backrest support and the other end contacting the backrest.

* * * * *